United States Patent [19]

Schrank

[11] Patent Number: 4,839,557

[45] Date of Patent: Jun. 13, 1989

[54] FILL MEMBER FOR ELECTROLUMINESCENT PANELS

[75] Inventor: Martin P. Schrank, Ipswich, Mass.

[73] Assignee: GTE Products Corporation, Danvers, Mass.

[21] Appl. No.: 134,646

[22] Filed: Dec. 18, 1987

[51] Int. Cl.[4] ..... H05B 33/04; H05B 33/10

[52] U.S. Cl. ..... 313/509; 313/512; 445/25; 445/43

[58] Field of Search ..... 313/512, 509; 445/25, 445/43

[56] References Cited

U.S. PATENT DOCUMENTS

| | | | |
|---|---|---|---|
| 3,330,982 | 7/1967 | Dickson, Jr. | 313/512 X |
| 4,213,074 | 7/1980 | Kawaguchi et al. | 313/512 X |
| 4,277,143 | 7/1981 | Pauli et al. . | |
| 4,357,557 | 11/1982 | Inohara et al. | 313/512 X |
| 4,447,757 | 5/1984 | Kawaguchi et al. | 313/512 X |
| 4,618,802 | 10/1986 | Schrank | 313/512 |

FOREIGN PATENT DOCUMENTS

| | | | |
|---|---|---|---|
| 0007695 | 1/1977 | Japan | 445/25 |

OTHER PUBLICATIONS

J. Addy et al., IBM Technical Disclosure Bulletin, vol. 23, No. 11 (Apr. 1981).

*Primary Examiner*—Palmer C. DeMeo
*Attorney, Agent, or Firm*—Martha Ann Finnegan

[57] ABSTRACT

The present invention is directed to a modified cover plate for a thin film electroluminescent display device. The cover plate of the present invention is provided with at least two diagonally disposed fill holes and complementary fill tubes. In the upper plane of the cover plate, the fill holes each comprise two concentrically positioned recesses, the outer one of which is of larger diameter, but smaller depth than the inner. Conversely, the inner recess is of smaller diameter, but larger depth than its concentric counterpart. In the lower plane of the cover plate, the fill holes are each provided with a pair of concentrically positioned recesses which complement those in the upper plane. At the planar junction of each of the smaller diameter (inner) recesses there is formed a passageway through the cover plate. The fill tubes are designed to be retained by the fill holes without adversely impacting the dimensional thickness of the panel.

12 Claims, 1 Drawing Sheet

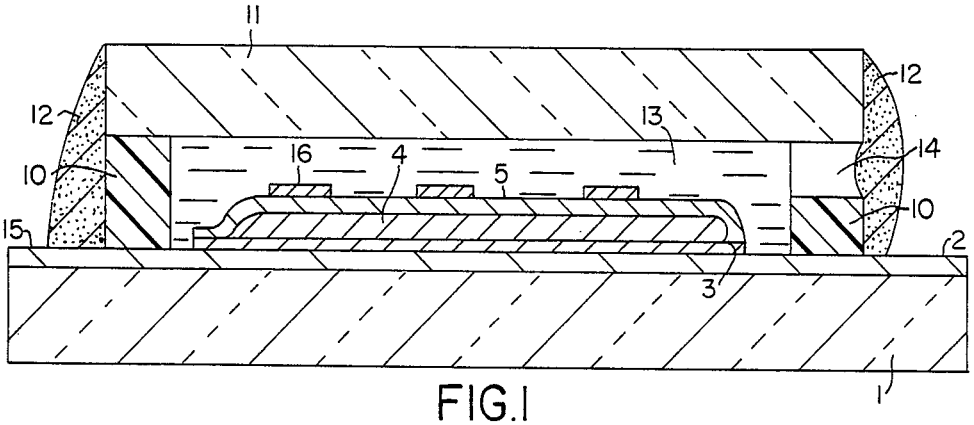
FIG.1
PRIOR ART
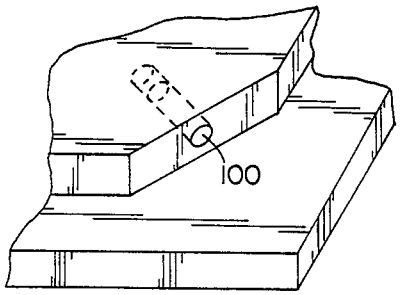
FIG.2
PRIOR ART
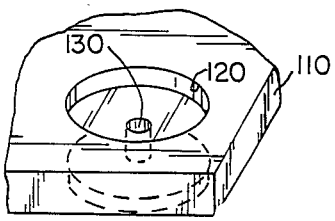
FIG.3
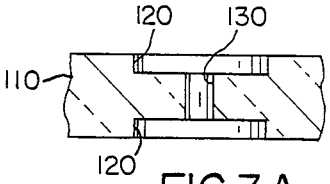
FIG.3A
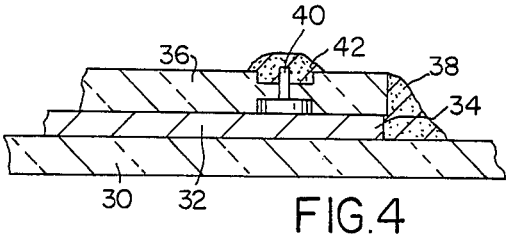
FIG.4
FIG.5
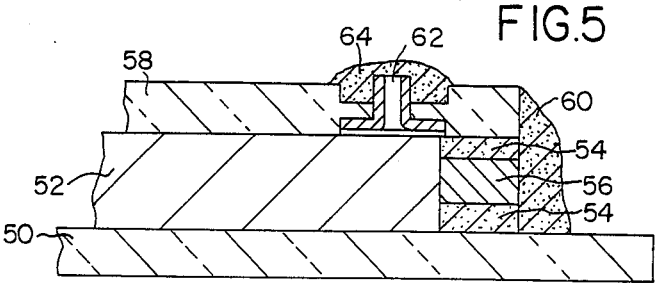

FILL MEMBER FOR ELECTROLUMINESCENT PANELS

STATEMENT OF GOVERNMENT INTEREST

The Government of the United States of America has certain rights to this invention pursuant to Contract No. DAAK 20-83-C-0378 awarded by the Department of the Army.

BACKGROUND OF THE INVENTION

The present invention relates to a thin film electroluminescent (TFEL) display panel and more particularly, to a thin-film electroluminescent display panel shielded by a pair of glass substrates with a protective material disposed therebetween.

For general background information on TFEL panels, see the "EL Glass Catalog and Design Handbook," Planar Systems, Inc., Beaverton, Oreg. 97006, the contents of which, to the extent necessary, are hereby incorporated herein by reference.

A conventional TFEL display panel is illustrated in FIG. 1, wherein the panel comprises a first transparent glass substrate a plurality of transparent electrodes 2 made of $In_2O_3$ or $SnO_2$, and the like, a first dielectric layer 3, an electroluminescent (EL) thin film 4, a second dielectric layer 5, a plurality of counter-electrodes 6 made of for example Al, spacers 10, and a counter-substrate or cover plate 11, which may be made of glass. See, for example, U.S. Pat. No. 4,213,074 to Kawaguchi et al.

As illustrated, the transparent electrodes 2 are arranged on the glass substrate 1 in parallel with each other. The counter-electrodes 6 are arranged so that they cross at a right angle relative to the transparent electrode 2 in a plane view. The cross points between each of the transparent electrodes 2 and the counter-electrodes 6 create a picture element (pixels) i.e., the image forming portion of the TFEL panel. A power source (not shown) is applied to the transparent electrode 2 and the counter-electrode 6.

The first dielectric layer 3 may comprise $Y_2O_3$, $TiO_2$, $Al_2O_3$, $Si_3N_4$, $SiO_2$, and the like, which may be deposited for example by a sputtering technique or by electron beam evaporation. The EL thin film 4 may be made for example, from a ZnS thin film doped with an impurity, for example manganese. The second dielectric layer 5 generally comprises a material similar to that of the first dielectric layer 3.

The TFEL panel is generally provided with a sealing structure for the EL composite member which comprises the first and second dielectric layers 3, 5 and the thin EL film 4. The cover plate 11, together with the transparent glass substrate 1, provide the basic structure for sealing the EL unit. The cover plate 11 need not be transparent because viewing may be conducted through the transparent glass substrate One or more spacers 10 may be employed for positioning the cover plate 11. An adhesive 12 is coated for bonding the transparent glass substrate 1, the spacer 10, and the cover plate 11.

An adhesive 12 is generally employed, which may be an epoxy resin or the like. Lead terminals 15 of the transparent electrodes 2 and the counter-electrodes 6 may be formed on the transparent glass substrate 1 and extended toward the cavity. A control circuit (not shown) is coupled to the lead terminals 15 to apply the power to the EL unit.

A protective substance 13 may be added to the cavity defined by the two plates 1 and A protective substance 13 functions to preserve the TFEL panel, especially the EL unit. The protective substance may be a gas or a liquid, but liquids are preferred. See, for example, U.S. Pat. No. 3,330,982 to Dickson, and U.S. Pat. No. 4,447,757 to Kawaguchi et al. Typical protective gases include inert gases such as nitrogen, argon, and the like. Typical protective liquids include silicon oils or greases.

A spacer 10 may be employed, and it may be formed from an insulating plastic sheet made of for example, a polyacetal resin or a polyimide resin, or a silicon rubber, or a glass plate. Finally, at least one fill hole 14 is generally provided, for the introduction of the protective substance 13.

If desired, a dye material or other color agent may be added to the protective substance in the TFEL panel to provide a background which can aid in the display characteristics of the panel.

TFEL panels of the type illustrated in FIG. 1 are very susceptible to moisture and therefore must be properly protected.

As discussed previously, the usual way to protect these panels is to cover the EL film with a transparent glass cover plate. This cover plate may be attached to the substrate plate by a perimeter seal, which is usually prepared from a moisture proof elastomer. In some cases glass frit seals have been applied, although such seals are impractical due to temperature limitations and chemical reactions with fritted-over contact leads.

TFEL panels that are merely protected by a cover plate also have a certain volume of air trapped in between which can vary in terms of humidity. Any water vapor coming into contact with the EL film will, over a period of time, interfere with the performance of the EL film, as the ZnS active layer is very hygroscopic.

The above-described sealing process could be conducted in either a dry nitrogen or argon atmosphere, or there could be incorporated into the EL unit a small amount of desiccant, such as silica gel or phosphorous pentoxide. See, for example, U.S. Pat. No. 4,357,557 to Inohara et al. However such procedures are not believed to readily lend themselves to mass production or to working with large TFEL panels.

One approach at providing a complete seal for an EL panel (to keep moisture out, protective substances in) involved sealing the two panels with a perimeter seal and leaving a small fill hole in the cover plate (perpendicular to the plate area). The panel was then immersed in an oil bath and the entire assembly placed in a vacuum oven. See for example U.S. Pat. No. 4,213,074 to Kawaguchi et al.

Any air trapped between the two panels escaped during the pumpdown process. After this the system was back filled with dry nitrogen which forced the oil through the hole and filled the volume between the two plates. While this method worked in principal, drawbacks included frequent explosions during pumpdown since the air above the oil bath was removed much faster than the air volume between the plates.

Another disadvantage with this method was the fact that there was generally a small bubble left after oil filling which could not be eliminated.

The most difficult problem involved the inability to seal the fill hole, due to the fact that it was covered with oil. Also the clean up of the panel was messy and time consuming.

An improvement in the above-described method was achieved by introducing small fill tubes attached to the cover plates. These tubes were connected to small "Tygon" hoses which were hung into the protective oil. The basic pumping procedure remained the same, and this modification eliminated the messiness and the wetting of the tip off area. However, the problems of explosions and residual volume were not solved.

Further progress in the introduction of protective liquids into TFEL panels was made by abandoning the vacuum method. Instead a syringe with two check valves was used to fill the panels in a relatively short time. The explosion problem, the residual "bubble", the oil wetting and the fill time factor were solved.

However, with the new modifications came geometric restrictions as to the thickness of the panel assembly due to the bezel construction. Thus, the fill tubes could no longer be mounted perpendicularly into the cover plate. This problem was solved by drilling a hole or channel parallel to the plate plane into the cover plate. A TFEL panel illustrating this type of fill hole 100 is shown in FIG. 2.

After filling the FIG. 2 type TFEL panel with a protective liquid, the fill tubes were crimped and tucked in the corner space and sealed over with epoxy. This solution seemed to be ideal. The panel kept its thickness and the oil fill technique was straight forward. The only real difficulty was in drilling the hole, but in most cases, it could be done.

In general, the thickness of the cover glass plates for TFEL panels prepared using the parallel hole filling method ranged from about 0.043 in. to 0.065 in. However, drilling a 0.040 in. diameter channel into the plate was almost impossible in the case of the thin glass, but having no protruding parts at the rear side of the panel seemed to justify this method of construction for a long time.

After a while, it was observed that a good number of parallel fill hole TFEL panels, at least about 20%, seemed to leak after a couple of days, especially after being handled frequently. Upon visual inspection, no direct leak along the seal areas could be found. After careful inspection under a microscope, hairline cracks were observed extending perpendicularly from the fill tube channel. While not wishing to be bound by theory, it is believed that the hydraulic forces during oil filling were strong enough to cause this breakage.

Clearly, the fill hole construction detail of TFEL panels had to be revised again.

The present invention is directed to this latest development in fill hole construction detail, solving the problems of the previously described designs, and resulting in a TFEL panel of exceptional strength and durability.

SUMMARY OF THE INVENTION

The TFEL panel of the present invention was designed to solve the aforementioned problems encountered in prior art. FIGS. 3 and 3A illustrate the fill hole design of the present invention on a conventional cover plate for a TFEL panel. Preferred embodiments of the TFEL panel of the present invention are set forth in FIGS. 4 and 5 of the attached drawings.

In the present invention, the fill hole arrangement involves the placement of two diagonally disposed fill holes in the cover plate, each fill hole comprising complementary planar (i.e., in the plane of the cover plate) concentrically positioned recesses. This fill hole construction provides a "countersink" effect for the fill holes on both planes (upper and lower) of the cover plate 110, see FIGS. 3 and 3A. Centrally situated through each of the larger recesses 120 is a small diameter hole or passageway 130, generally about 0.040 in. in diameter, adapted to receive and retain a fill tube.

The large diameter recessed portions of the fill holes of the present invention 120 are designed so as to accept sealing materials and not change the thickness dimensions of the cover plate or any other part of the TFEL panel. A fill tube (not shown) is inserted into each of the smaller diameter passageways of the fill holes 130, and held in place by a flange which fits precisely into the larger recesses of the fill holes of the cover plate. The flange may be retained by a sealing material such as an adhesive or a glass frit.

This fill hole/fill tube design is useful for constructing TFEL devices ranging in size from about 2 in.×3 in. to about 40 in.×40 in.

Thus, the present invention is directed to a modified cover plate for a thin film electroluminescent display device comprising in combination a non-conductive (e.g. glass) cover plate and a non-conductive (e.g., glass) substrate disposed so as to define a cavity therebetween; a composite member comprising a thin film electroluminescent layer sandwiched between a pair of dielectric layers, said composite being transparent to light emitted by said electroluminescent layer when activated; a pair of opposing electrodes positioned to define said composite therebetween; a protective liquid disposed within said cavity defined by said substrates and being in contact with said dielectric layers; the cover plate being provided with at least two diagonally disposed fill holes.

In the upper plane of the cover plate, the fill holes each comprise two concentrically positioned recesses, the outer one of which is of larger diameter, but smaller depth than the inner. Conversely, the inner recess is oil smaller diameter, but larger depth than its concentric counterpart.

In the lower plane of the cover plate, the fill holes are each provided with a pair of concentrically positioned recesses which complement those in the upper plane.

Each of the smaller diameter (inner) recesses forms a passageway through the cover plate. See, for example, the small diameter hole of passageway 130 which passes through the cover plate 110, as shown in FIG. 3 and 3*a*.

Through this passageway there is placed a fill tube, with a flange which fits within the large Unlike previous fill hole construction arrangements, this combination of planar concentric recesses provides fill holes having a "counter-sink" appearance, which allows the sealing material to remain substantially in the plane of the cover plate on both its upper and lower sides, thereby reducing the chance of leakage due to surface irregularities.

BRIEF DESCRIPTION OF THE DRAWINGS

FIG. 1 is a cross-sectional view of a typical thin film electroluminescent panel.

FIG. 2 is a plan view of the parallel fill hole construction of glass cover plates for TFEL panels.

FIG. 3 is a plan view of the complementary planar concentric recesses fill hole of the present invention; FIG. 3A represents a cross-sectional view of the same.

FIG. 4 is a cross-sectional view of a TFEL panel up to about 10 in.×14 in according to the present invention.

FIG. 5 is a cross-sectional view of a "square-meter" (40 in.×40 in.) TFEL panel according to the present invention.

DETAILED DESCRIPTION OF THE PREFERRED EMBODIMENT

The present invention relates to a thin film electroluminescent (TFEL) display panel and more particularly, to a thin-film electroluminescent display panel shielded by a pair of glass substrates with a protective liquid disposed therebetween As illustrated in FIG. 3, the cover plates have two fill holes, preferably diagonally opposed at two corners of the cover plate. The complementary concentrically arranged recesses are drilled perpendicularly into each plane (upper and lower) of the cover plate. The skilled artisan will recognize that this "countersink" configuration will not impinge on the thicknesses dimension requirements of the panel. It will also be recognized that the two fill holes could be placed anywhere on the cover plate, but that the illustrated diagonal disposition aids in the rapid distribution of the protective liquid.

Referring to FIGS. 4 and 5, there are illustrated two preferred TFEL panels prepared in accordance with the present invention. Each of the EL units is disposed on a transparent electrode which is formed on a transparent glass substrate. The cover plates are positioned on the transparent glass substrate so as to enclose the EL unit through the use in FIG. 5 of an optional spacer. An adhesive is used to seal the edges of the two glass sections and, and the spacer except where the fill tube hole is located.

In preferred embodiments, cover plates have a thickness of about 0.065 in. with the exception of the square meter panels (40 in.×40 in.) which have a cover plate thickness of about 0.125 in.

The formation of the fill holes of the present invention requires a series of drilling operations. First, the inner or small diameter holes (generally about 0.040 in.) are drilled completely through the cover plate in their respective locations. Thereafter, the outer recesses (diameter generally about 0.080–0.100 in.) are drilled on each planar side of the cover plate, providing the "countersink." This preferred method forms both the upper and lower planar passageway in one motion. Alternatively, each side (upper and lower) could be drilled separately to form the passageway and the corresponding "countersink."

The fill holes are preferably formed with the aid of a semiautomatic drill press. Depth and speed are preferably programmed into the drill press by a microprocessor in order to guarantee reproducibility from plate to plate.

After creation of the fill holes, fill tubes, such as ¾ in. long "Kovar" tubes (or its equivalent, e.g., Rodar) having an outer diameter corresponding to the diameter of the inner holes, with a flange having a diameter corresponding to the outer recess are inserted into the cover glass. The flange is prepared by mechanically flaring-out one end of the Kovar tube, preferably using a spinning stylus. Alternatively, other flaring means may be employed as will be apparent to the skilled artisan. The Kovar tubes, with or without a flared end, can be obtained commercially from: Uniform Tubes, Inc., Collegeville, Pa. 19426.

If the panels are to be sealed with a frit seal, then the fill tubes may also be sealed into the concentric openings with a glass frit. A preferred frit for this technique is Frit Type SG 100 prepared from an admixture of 200 mesh soda lime glass (available from Owens-Illinois) and a vehicle such as terpineol. The admixture is prepared as a flowable paste, used to seal the fill tube in place, and the vehicle is removed by healing the plate to about 350° C. for about 1 hour. Then the temperature is increased to about 420° C. for about 20 minutes to sinter the glass frit into a solid rivet-like component.

In the currently envisioned best modes, all of the panels are sealed by using organic adhesives. The most preferred organic sealing material is a silicon oil compatible epoxy, such as Torr Seal, available from Varian Associates.

The cover plates are then provided with a perimeter seal, about ⅛ in. wide. A generally useful material for this seal is a double adhesive tape, about 0.010 in. thick, such as 3M Tape No. Y9473. For small cover plates (up to about 12×15 in.) the 10 mil. thickness of this tape is sufficient to prevent the panels from touching. For larger panel, a 15 or 20 mil. thick tape should be employed.

The cover plates are next placed in a vacuum oven to remove surface moisture. After this treatment, an additional bead of a two compound epoxy is applied around the edge of the cover plate to prevent chipping. A preferred epoxy material for this use is 3M Epoxy Type No. 1838L, A&B. The assembly is placed on a hot plate at about 100° C. for about two hours after which the epoxy is cured.

After this heat treatment, the panels are oil filled, preferably by using a syringe attached to one of the fill tubes. The preferred protective oil is a silicon oil, such as Dow Corning Type 704.

If desired, a dye material or other color agent may be added to the protective oil to aid in the display characteristics of the panel.

After the panels are filled, the fill tubes are crimped and pinched off and then sealed over with an epoxy to smooth over the jagged end of the crimped-off tube.

In the case of a frit seal the tubes are crimped off and sealed with a spot welder. An additional da of epoxy can be employed to make the junction smooth.

This type of fill tube construction works very reliably since there is no weak spot around the fill opening. The epoxy seal around the tube acts like a rivet which can neither pop in nor pop out.

The present invention will be further illustrated with reference to the following examples which aid in the understanding of the present invention, but which are not to be construed as limitations thereof.

EXAMPLE 1

The TFEL panel of FIG. 4 represents a typical small panel prepared according to the teachings of the present invention.

The glass substrate 30 is coated using conventional techniques with the film stack 32, i.e., the active thin film, the dielectrics the like. Double adhesive tape (3M) 34 serves as both a spacer and as the means for attaching the glass cover plate 36 to the panel. Epoxy (3M) 38 is used as a perimeter seal around the junction between the cover plate to the glass substrate. Protective oil is added through fill in FIG. 3A and the Kovar fill tubes are sealed by Torr Seal 42 (Varian) adhesive.

All of the activities set forth above are conducted in a clean room, thereby ensuring maximum cleanliness and structural integrity of the assembled component parts.

EXAMPLE 2

The TFEL panel of FIG. 5 represents a typical large panel prepared according to the teachings of the present invention.

The glass substrate 50 is coated using conventional techniques with the film stack 52, i.e., the active thin film, the dielectrics, and the like. Double adhesive tape (3M) 54 retails an acrylic spacer ($\frac{3}{8}$ in. wide$\times\frac{1}{8}$ in. thick) 56 holds the 0.125 in. thick glass cover plate 58 to the panel. Epoxy (3M - 1838L) 60 is used as a perimeter seal around the junction between the cover plate to the glass substrate. Protective oil is added through fill hole 62, which has the countersunk design illustrated in FIG. 3A and the nickel fill tubes are sealed by Torr Seal (Varian) adhesive 64.

All of the activities set forth above are conducted in a clean room, thereby ensuring maximum cleanliness and structural integrity of the assembled component parts.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A method of fabricating a thin-film electroluminescent display panel on a transparent substrate comprising:

disposing a cover plate relative to the transparent substrate in such a manner as to define a cavity therebetween, said cavity containing a thin-film electroluminescent composite member;

providing said cover plate with at least two fill holes with each fill hole retaining a fill tube therein, each fill hole comprising complementary planar concentrically positioned recesses, the outer recesses being of larger diameter, but smaller depth than the inner recesses, each of the inner, smaller diameter recesses forming a passageway through the cover plate from one outer recess to its complementary outer recess in the opposing plane of the cover plate; and introducing a protective liquid into said cavity through one of said fill tubes in said fill holes, the protective liquid being adapted to cover and penetrate the thin-film electroluminescent composite member.

2. The method according to claim 1, which further includes the step of providing spacer means for determining the position of the cover plate relative to the transparent substrate.

3. The method according to claim 2, further including the step of utilizing an adhesive for combining the transparent substrate, the cover plate and spacer means together.

4. A thin-film electroluminescent display panel comprising:

a non-conductive cover plate and a non-conductive substrate disposed so as to define a cavity therebetween;

a composite member comprising a thin film electroluminescent layer sandwiched between a pair of dielectric layers, said composite member being transparent to light emitted by said electroluminescent layer when activated;

a pair of opposing electrodes positioned to define and activate said composite member therebetween;

a protective liquid disposed within said cavity defined by said cover plate and said substrate and being in contact with said dielectric layers;

the cover plate being provided with at least two diagonally disposed fill holes with each fill hole retaining a fill tube therein;

each fill hole comprising complementary planar concentrically positioned recesses, the outer recesses being of larger diameter, but smaller depth than the inner recesses, each of the inner, smaller diameter recesses forming a passageway through the cover plate from one outer recess to its complementary outer recess in the opposing plane of the cover plate.

5. The display panel according to claim 4, wherein said protective liquid is a silicone oil.

6. The display panel according to claim 4, wherein the substrate comprises transparent glass.

7. The display panel according to claim 6, wherein spacer means are provided between the cover plate and the glass substrate for determining the position of each relative to the other.

8. The display panel according to claim 7, wherein an adhesive is further provided for combining the substrate and the cover plate to one another.

9. The display panel according to claim 8, wherein the dielectric layers completely enclose the thin-film electroluminescent layer.

10. The display panel of claim 9, wherein electrodes are provided on each of the dielectric layers.

11. The display panel according to claim 9, wherein said protective liquid further includes a dye material or color agent to aid in the display characteristics of the panel.

12. A thin-film electroluminescent display panel comprising:

a pair of non-conductive members, at least one of which is transparent, disposed as to define a cavity therebetween;

a composite comprising a thin film electroluminescent layer sandwiched between a pair of dielectric layers, said composite being within said cavity, said transparent member being transparent to light emitted by said electroluminescent layer when activated;

a pair of opposing electrodes positioned to define said composite therebetween;

spacer means provided between said pair of non-conductive members for determining the position of said members relative to each other;

a protective liquid disposed within said cavity defined by said members and being in contact with said dielectric layers;

at least two fill holes with each fill hole retaining a fill tube therein, said fill holes being formed in one of said members for introducing said protective liquid into said cavity;

said fill holes comprising complementary planar concentrically positioned recesses, the outer recesses being of larger diameter, but smaller depth than the inner recesses, each of the inner, smaller diameter recesses forming a passageway through the non-conductive member from one outer recess to its complementary outer recess in the opposing plane of the non-conductive member.

* * * * *